US005878533A

United States Patent [19]

Swanfeld, Jr.

[11] Patent Number: 5,878,533

[45] Date of Patent: Mar. 9, 1999

[54] HEATED GUTTER SYSTEM

[75] Inventor: Edward Swanfeld, Jr., Turnersville, N.J.

[73] Assignee: E & T Tooling Inc., Swedesboro, N.J.

[21] Appl. No.: 780,407

[22] Filed: Jan. 9, 1997

[51] Int. Cl.[6] ..... E04D 13/076

[52] U.S. Cl. ..... 52/11; 219/213; 248/73

[58] Field of Search ..... 52/11, 173.1; 219/213; 248/48.1, 48.2, 65, 73

[56] References Cited

U.S. PATENT DOCUMENTS

| | | | |
|---|---|---|---|
| 2,111,251 | 3/1938 | Spilsbury | 108/26 |
| 3,521,029 | 7/1970 | Toyooka et al. | 219/201 |
| 3,694,622 | 9/1972 | Bentley | 219/213 |
| 3,795,271 | 3/1974 | Adamic | 165/47 |
| 3,821,512 | 6/1974 | Stanford | 219/213 |
| 3,823,304 | 7/1974 | Siemianowski | 219/213 |
| 4,043,527 | 8/1977 | Franzmeier | 248/65 |
| 4,134,002 | 1/1979 | Stanford | 219/213 |
| 4,308,696 | 1/1982 | Schroeder | 219/213 |
| 4,401,880 | 8/1983 | Eizenhoefer | 219/213 |
| 4,769,526 | 9/1988 | Taouil | 219/213 |
| 5,315,090 | 5/1994 | Lowenthal | 219/213 |
| 5,391,858 | 2/1995 | Tourangeau et al. | 219/213 |

*Primary Examiner*—Michael Safavi
*Attorney, Agent, or Firm*—Norman E. Lehrer

[57] ABSTRACT

A heated gutter system for preventing the build up of ice and snow on and in a roof gutter. The roof gutter includes a bottom wall, an upper wall, a front wall, a rear wall, and a pair of opposing ends. The upper and front walls have a space therebetween. A plurality of support brackets are positioned in the gutter along the length of the same. Each of the support brackets has a groove formed therein which is positioned adjacent the rear wall of the gutter. The groove in each of the brackets is aligned with the grooves in the other brackets. A heating element extends along the length of the gutter in between the grooves in each of the bracket.

4 Claims, 1 Drawing Sheet

HEATED GUTTER SYSTEM

BACKGROUND OF THE INVENTION

The present invention is directed toward a heated gutter system and, more particularly, to such a system which will prevent ice from building up on and around a gutter.

During periods of cold weather, it is common for significant amounts of snow and ice to build up on a roof. Such snow and ice also fills the gutter which extends along the roof edge. As the gutter is filled with snow and ice, an ice dam may be created which completely covers the rain gutter and the roof edge from which the gutter extends. Oftentimes, the level of snow and ice extends a substantial distance above the level of the drain pipes. When the gutter is so filled, the eventual thawing of the snow and ice during warm periods of the day causes water to seep in between the roof shingles and drain into areas of the attic or ceiling thereby causing structural damage.

In recognition of the foregoing, various devices have been designed for preventing ice from building up in a gutter by supplying heat to the same. For example, U.S. Pat. No. 4,043,527 to Tourangeau et al. discloses securing several heating elements, which are connected to a power source, in or adjacent to a gutter. Specifically, the Tourangeau et al. patent discloses securing an elongated panel to a roof edge. A plurality of conduits are secured to the undersurface of the panel. A separate heating element is inserted through each of the conduits. A conduit is similarly secured to the bottom of the gutter, which has yet another a heating element extending therethrough. Obviously, the installation of the panel, conduits and heating elements would be expensive, time consuming and labor intensive.

U.S. Pat. No. 4,043,527 to Franzmeier discloses securing a heating element in a zig zag configuration adjacent the edge of a roof. However, the heating elements do not extend into the gutter. Accordingly, snow and ice may build up in the same. Further, the installation of the heating elements is labor intensive.

U.S. Pat. No. 2,111,251 to Spilsbury discloses securing a heating element across the bottom of a gutter. The heating element is supported by an elongated curved portion which extends across the bottom of gutter along the entire length of same. The Spilsbury device is not intended to be secured to a gutter which is already secured to a roof edge. Rather, the Spilsbury heating element is intended to be secured to the bottom of the gutter before the gutter is secured to the roof edge.

SUMMARY OF THE INVENTION

The present invention is designed to overcome the deficiencies of the prior art discussed above. It is an object of this invention to provide a heated gutter system which is relatively inexpensive and easy to install.

It is a further object of the invention to provide such a heated gutter system which can be installed to a gutter which is secured in place adjacent a roof edge.

In accordance with the illustrative embodiments, demonstrating features and advantages of the present invention, there is provided a heated gutter system for preventing the build up of ice and snow in a roof gutter. The roof gutter includes a bottom wall, an upper wall, a front wall, a rear wall, and a pair of opposing ends. The upper and front walls have a space therebetween. A plurality of support brackets are positioned in the gutter along the length of the same. Each of the support brackets has a groove formed therein which is positioned adjacent the rear wall of the gutter. The groove in each of the brackets is aligned with the grooves in the other brackets. A heating element extends along the length of the gutter in between the grooves in each of the brackets.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
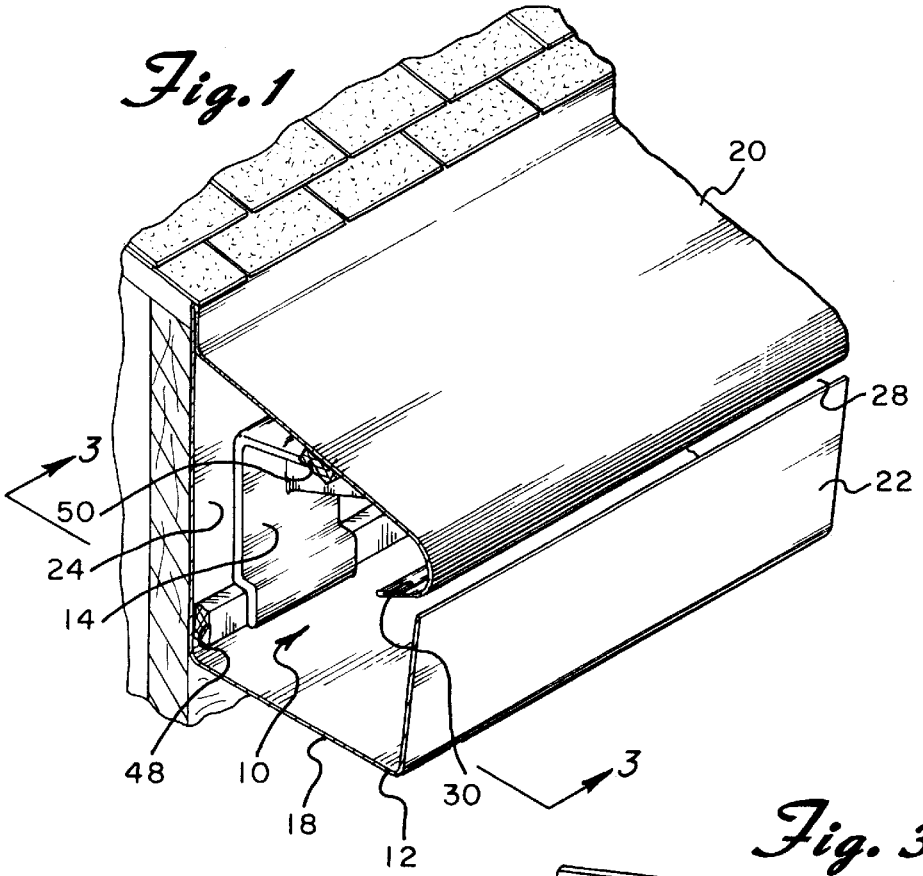
FIG. 1 is a perspective view of the heated gutter system of the present invention shown installed in a roof gutter.
Figure 3:
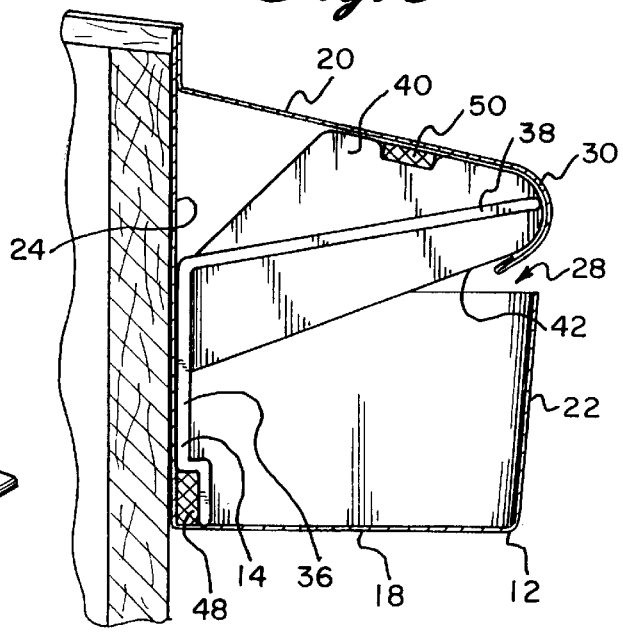
FIG. 3 is a cross-sectional view taken along lines 3—3 of FIG. 1.

Referring now to the drawings in detail wherein like reference numerals have been used throughout the various figures to designate like elements, there is shown in FIGS. 1 and 3 a heated gutter system constructed in accordance with the principles of the present invention and designated generally as 10.

The heated gutter system essentially includes a roof gutter 12, a plurality of support brackets 14 positioned in the gutter along the length of the same, and heat generating means positioned between the support brackets and the gutter for supplying heat to the gutter in order to prevent the build up of ice and snow on or in the same.

The roof gutter 12 preferably has a bottom wall 18, an upper wall 20, a front wall 22, and a rear wall 24. The upper wall and the front wall have a space 28 located therebetween. In the preferred embodiment, the upper wall 20 extends outwardly from the rear wall 24 and terminates in a curved portion 30. The roof gutter is preferably comprised of a corrosion resistant material.

Positioned in the gutter, along the length of the same, are a plurality of support brackets. The number of support brackets is dependent on the length of the gutter 12. In the preferred embodiment, each support bracket is spaced about two to three feet from adjacent support brackets. Each support bracket is positioned in the gutter by inserting the same through one of the open ends in the gutter and then pushing the bracket until it reaches a desired location. The support brackets are preferably comprised of a plastic material.

Figure 2:
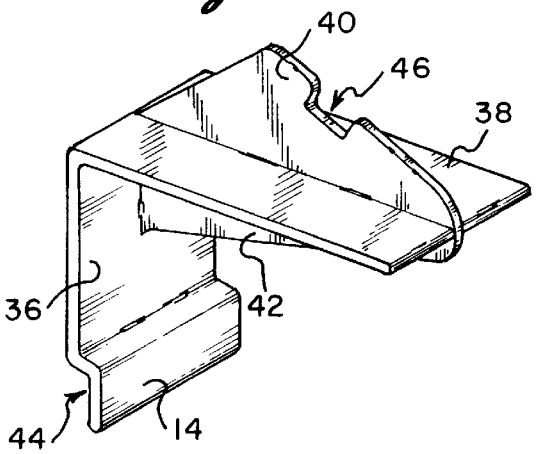
FIG. 2 is a perspective view of the support bracket for the heating element of the heated gutter system of the present invention.

While only one support bracket 14 is shown and described, it should be noted that the other support brackets are substantially identical to the same. Support bracket 14 includes a first segment 36 in the form of a rear wall and a second segment 38 which extends outwardly from the first segment. The second segment includes an upper flange 40 extending upwardly therefrom and a lower flange 42 extending downwardly therefrom (FIGS. 2 and 3). The flanges 40 and 42 are designed to contact the inside of the upper wall 20 of the gutter 12 while the first segment 36 contacts the rear wall 24 of the gutter as best shown in FIG. 3. Nails or screws are preferably driven through the first segment 36, through the rear wall 24 of the gutter 12, and into the building facia in order to hold the gutter in place and to firmly secure the support bracket in the gutter.

The first segment 36 of the support bracket 14 has a groove 44 formed therein (FIG. 2). Similarly, a groove 46 is formed in the upper flange 40 of the second segment 38 of the support bracket 14. When the support bracket 14 is positioned in the gutter 12, groove 44 is positioned adjacent the rear wall 24 of the gutter 12 and groove 46 is positioned adjacent the upper wall 20 of the gutter. It should be noted that when all of the support brackets are positioned in the gutter 12, the grooves in each of the first segments of the support brackets are aligned with one another and the grooves in the flanges in each of the second segments are similarly aligned with one another.

In the preferred embodiment, the heat generating means includes two separate resistance heating elements 48 and 50 which are connected to a power source of a type generally known in the art (FIGS. 1 and 3). The power source electrically supplies heat through the heating elements. Heating element 48 extends through each of the grooves in the first segments of the support brackets. Heating element 50 extends through each of the grooves in the upper flanges of the second segments of the support brackets. The heating elements extend along the entire length of the gutter 12.

When snow and ice begin to accumulate on or near the roof gutter 12, the power source is activated so that heat is sent through the heating elements 48 and 50. The transmission of heat through the heating elements ensures that any snow and ice that has formed on the gutter will rapidly melt.

The present invention may be embodied in other specific forms without departing from the spirit or essential attributes thereof and accordingly reference should be made to the appended claims rather than to the foregoing specification as indicating the scope of the invention.

What is claimed is:

1. A heated gutter system for preventing the build up of ice and snow on and around a roof gutter comprising:

a roof gutter having a bottom wall, an upper wall, a front wall, and a rear wall, said upper wall extending outwardly from said rear wall and said upper wall and said front wall having a space therebetween;

a plurality of support brackets positioned in said gutter along the length of the same, each of said support brackets having a groove therein, said groove in each of said brackets being positioned adjacent one of said walls of said gutter, each of said support brackets including a first segment and a second segment, said second segment extending outwardly from said first segment, each of said first and second segments of each of said support brackets having a groove therein, said second segment having two flanges which contact said upper wall and said first segment contacting said rear wall; and heat generating means extending along the length of said gutter and within said grooves in each of said brackets.

2. The heated gutter system of claim 1 wherein said heat generating means includes two heating elements, one of said heating elements extending through said grooves in each of said first segments of said support brackets, the other of said heating elements extending through said grooves in each of said second segments of said support brackets.

3. The heated gutter system of claim 1 wherein said groove in each of said first segments of said support brackets is positioned adjacent said rear wall of said gutter and wherein said groove in each of said second segments of said support brackets is positioned adjacent said upper wall of said gutter.

4. The heated gutter system of claim 1 wherein said upper wall of said gutter includes a curved portion, said curved portion of said upper wall being positioned adjacent said front wall of said gutter, said second segment of each of said support brackets being supported in said curved portion of said upper wall of said gutter.

* * * * *